United States Patent [19]

Ruenzi

[11] 4,212,456

[45] Jul. 15, 1980

[54] APPARATUS FOR AUTOMATICALLY FEEDING INDIVIDUAL SHEETS FROM A STACK THROUGH AN OFFICE MACHINE

[76] Inventor: Kurt Ruenzi, 8126 Zumikon, Switzerland

[21] Appl. No.: 940,213

[22] Filed: Sep. 7, 1978

Related U.S. Application Data

[63] Continuation-in-part of Ser. No. 779,755, Mar. 21, 1977, Pat. No. 4,113,244, which is a continuation-in-part of Ser. No. 674,918, Apr. 8, 1976, Pat. No. 4,032,135.

[30] Foreign Application Priority Data

Apr. 15, 1975 [CH] Switzerland ..... 4758/75

[51] Int. Cl.[2] ..... B65H 5/22

[52] U.S. Cl. ..... 271/4; 271/22; 271/110; 271/121; 271/127; 271/186; 400/625; 400/629

[58] Field of Search ..... 400/624, 625, 629; 271/4, 110, 111, 121-125, 127, 225, 186, 22

[56] References Cited

U.S. PATENT DOCUMENTS

| | | | |
|---|---|---|---|
| 2,366,206 | 1/1945 | Metzner | 400/625 |
| 2,813,612 | 11/1957 | Berglund | 400/625 |
| 3,919,972 | 11/1975 | Komori | 271/127 X |
| 3,981,497 | 9/1976 | Feinstein | 271/110 X |

*Primary Examiner*—Richard A. Schacher
*Attorney, Agent, or Firm*—W. G. Fasse; D. F. Gould

[57] ABSTRACT

This apparatus removes individual sheets of paper or the like from a stack regardless of the thickness of each sheet. A sheet supply stack support is journaled in a housing in see-saw fashion. A first set of sheet separating rollers is arranged above the downstream end of the support as viewed in the direction of sheet movement. A spring urges the downstream end of the support upwardly and thus sheets on the support against a separating roller. A table is located substantially adjacent the downstream end of a sheet and for cooperation with a pair of sheet separating and transport rollers. Two sheet guides are arranged upstream and downstream, for example, of a platen. The supply stack is arranged upstream of the first sheet guide. The sheet receiving stack is arranged downstream of the platen and so that an upper sheet guide member forms part of a sheet receiving stack tray located substantially above the sheet supply stack. Both stacks may be arranged at any desired angle between the horizontal and a line forming a steep angle relative to the horizontal.

3 Claims, 9 Drawing Figures

APPARATUS FOR AUTOMATICALLY FEEDING INDIVIDUAL SHEETS FROM A STACK THROUGH AN OFFICE MACHINE

CROSS REFERENCE TO RELATED APPLICATIONS

This application is a continuation-in-part application of my copending application Ser. No.: 779,755; filed on Mar. 21, 1977, now U.S. Pat. No. 4,113,244, granted Sept. 12, 1978. U.S. Ser. No.: 779,755 is in turn a continuation-in-part application of U.S. Ser. No.: 674,918; filed on Apr. 8, 1976, now U.S. Pat. No. 4,032,135 granted on June 28, 1977.

BACKGROUND OF THE INVENTION

The invention relates to an apparatus for individually removing sheets from a stack of sheets, for example, paper or the like, including a sheet stack support member and several power driven sheet separating roller sets. More specifically, the invention relates to an apparatus for guiding and supplying the individual sheets from a stack through an office machine and out again onto a sheet receiving stack.

Sheet separating devices for paper sheets or the like are well known. These devices supply the sheets to office machines, such as printers, duplicators, copiers or to other paper processing machines. Prior art devices are constructed in such a manner that they must be adjusted precisely to the particular type of paper thickness employed for any particular type of operation. If it is necessary to change to another paper thickness a careful new adjustment must be made. The required adjustments make the conventional paper feeders or sheet separators expensive and subject to trouble which may occur, because the adjustment has changed during the operation. Further, adjustments are time consuming.

In many office machines it is customary to use interfolded, continuous sheets of paper or sets of office form. This is, for example, the case in automatic typewriters, accounting machines and data processing machines. Such continuous, interfolded forms are provided with a row of apertures running along one edge or margin of the sheet for assuring a line true feed advance of the sheet in the machine. After the continuous sheets have passed through the office machine, they are separated from each other, and it is necessary to remove the margin of an apertured strip. This strip removal involves additional labor and may even require additional machines which can remove the margin. Thus, these machines have the common disadvantages that pre-printed letterheads, invoice forms, and the like, which are available as individual sheets only, cannot be used in this type of machine which makes it necessary to have these forms and letterheads prepared especially for use in the just described type of machine. U.S. Pat. No. 3,963,110 describes a storage magazine and sheet feeder for a typing apparatus such as a tape driven typewriter, wherein the tray for supplying new sheets and the tray for receiving the typed up sheet extends at a steep angle above the typewriter platen, presumably, to take advantage of gravity for feeding the sheets to the typewriter platen. However, while this may be advantageous as far as the sheet supply is concerned, it is not desirable as far as the sheet removal is concerned because the sheets have to be driven against gravity up again. Moreover, there is no assurance in this type of feeder that only one sheet at a time or one set of sheets at a time will be supplied to the platen regardless of the thickness of the sheet or set of sheets.

Similar considerations apply to the paper feeder according to U.S. Pat. No. 3,430,748 which is coordinated with the platen in a typewriter which also does not assure that one and only one sheet or one set of sheets will be supplied to the platen. Similar considerations apply to the feeder and guide mechanism shown in U.S. Pat. No. 3,840,222.

OBJECTS OF THE INVENTION

In view of the above, it is the aim of the invention to achieve the following objects, singly or in combination:

to separate sheets of paper from a stack individually and independently of the thickness of the paper sheets;

to provide an apparatus capable of separating paper sheets from a stack, whereby the individual sheets of paper may have different thicknesses even in the same stack;

to construct the sheet separating apparatus in such a manner that transporting more than one sheet or one set of sheets at a time regardless of the thickness of the sheets or sets of sheets will be avoided;

to provide a sheet feeder which will supply individual sheets without a perforated margin into office machines, such as automatic typewriters, accounting machines, data processing machines, copiers, and teletypewriters, whereby said feeding must be automatic and precise;

to feed sheets into machines of the type just mentioned while maintaining the supply magazine as well as the receiving magazine in any desired angular position relative to the horizontal position; and to construct the sheet guide mechanism in such a compact manner that a sheet guide member guiding sheets downstream of the platen simultaneously forms part of a sheet receiving stack support substantially upstream of said platen.

SUMMARY OF THE INVENTION

According to the invention there is provided an apparatus for individually removing or separating sheets from a stack, wherein the sheet stack support is constructed as a see-saw and wherein a separating roller cooperates with the see-saw and with a guide table and stop for the sheet removal and advance from the supply stack. One sheet at a time will pass through the apparatus to avoid clogging. A spring urges the see-saw type of support and thus the sheets of paper on the supply support against a separating roller rotatably supported in the housing of the apparatus and positively driven, for example, by gear belts from a platen. A table or surface is arranged substantially adjacent to the downstream end of the supply support and a first pair of positively driven rollers is arranged just downstream of the table as viewed in the sheet advance direction. A stop surface or member is arranged downstream and adjacent to the sheet stack supply support. The stop surface may form part of the table. The table, the stop, and the separation roller are arranged in such a manner relative to each other that the separation roller may slightly buckle the leading edge of a sheet against the top edge or corner of the stop, whereby the sheet edge may jump onto the table.

According to the invention, there is further provided a first set of sheet guide members which supply the sheets or sets of sheets individually from the above described sheet separating means, toward a roller such as the platen in a typewriter on the back side or upstream side thereof. One of the first sheet guide members may be arranged to simultaneously form part of a sheet receiving stack support. The other guide member guides the sheet around the platen. A second set of guide means is arranged to cooperate with a further pair of positively driven rollers to guide the sheets backwardly into a tray arranged somewhat above the supply tray. This combination of elements makes it possible to use standard letterheads, pre-printed forms, invoice forms and the like, without any continuous folding and also without any marginal perforations. The invention has the further advantage that the subsequent separation of sheets from an endless interfolded sheet supply becomes unnecessary. Similarly, the removal of the perforated margin has been avoided, according to the invention. A still further advantage of the invention is seen in that it may be combined with any conventional office machine and may also be removed as an integral structural unit.

The above combination of features according to the invention has the further advantage that no adjustment of the various elements relative to each other is necessary while simultaneously sheets of paper having different thicknesses may be processed. Even in one and the same stack the sheets may have individually differing thicknesses.

BRIEF FIGURE DESCRIPTION

In order that the invention may be clearly understood, it will now be described, by way of example, with reference to the accompanying drawings, wherein:

FIG. 1 is a vertical section through the sheet separator of my above first mentioned U.S. Pat. No. 4,032,135;

DETAILED DESCRIPTION OF PREFERRED EXAMPLE EMBODIMENTS

Figure 1:
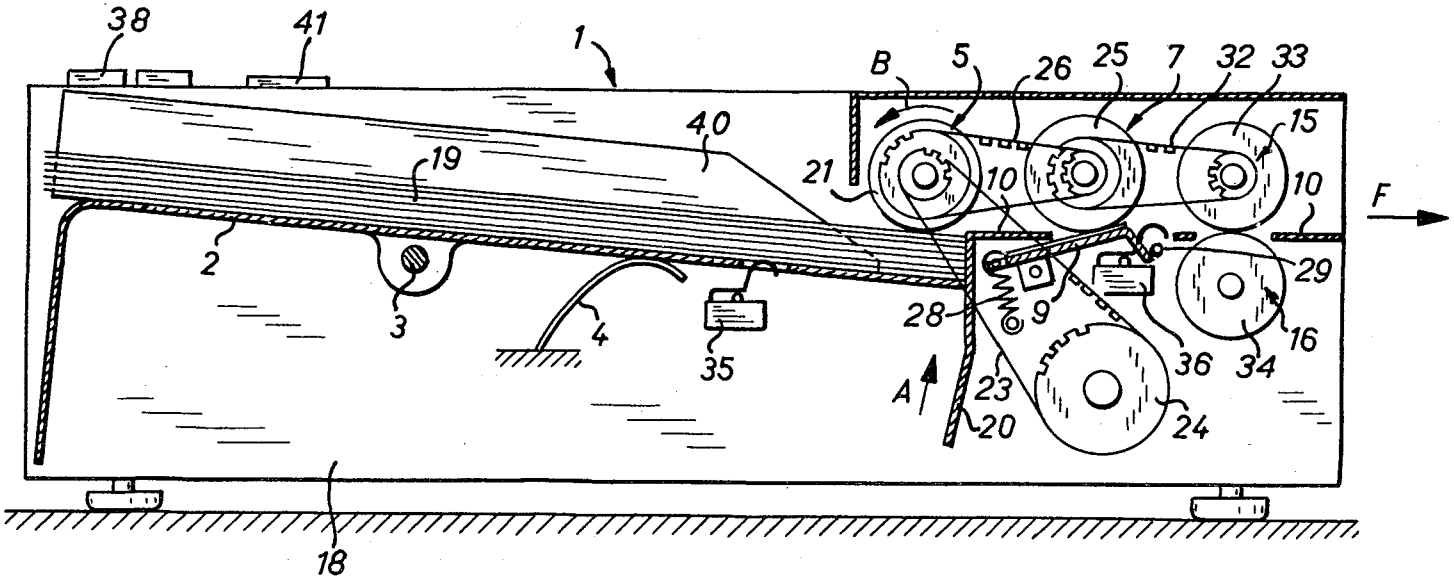

Referring to FIG. 1 the sheet separating apparatus of U.S. Pat. No. 4,032,135 includes a housing 1 made of sheet metal or plastics material. A sheet supply stack support 2 is journaled in the housing in the manner of a see-saw. The support carries a stack 19 of paper sheets to be individually removed from the stack 19 for further processing to and around the platen 361. The journal axis 3 of the see-saw type of support 2 is secured to the side walls 18 of the housing 1 for a tilting movement. The journal axis 3 extends horizontally through the housing. The support 2 is urged in the direction of the arrow A upwardly by means of a relatively weak spring 4. The stack 19 of sheets of paper or sets of sheets with carbon paper therebetween is manually placed on top of the support 2 in such a manner that the forward edge of the stack rests snuggly against a substantially vertically extending stop member 20. An upwardly extending wall member 40 is laterally adjustable back and forth to fix the position of the supply stack in the lateral direction.

Referring further to FIG. 1, a first sheet separating set of rollers 5 is supported for rotation in the housing 1 above the downstream end of the stack 19 and close to the stop member 20. The set 5 of sheet separating rollers comprises a plurality of rollers 21 axially spaced along and rigidly secured to a horizontal shaft 5, which in turn is rotatably supported in the side walls of the housing 1. A drive motor 24 drives the shaft 5 in the direction of the arrow B by means of a power transmission element such as a gear belt 23. The top sheet on the stack comes into contact with the lower surface of the rollers 21 because the spring 4 urges the support 2 and thus the stack 19 lightly in the upward direction and hence against the rollers 21. The line of contact between the top sheet and the rollers 21 is located practically at the same level as a substantially horizontally extending table surface 10 of metal, plastics, or the like. The sheets travel individually over the table surface 10 in the direction of the arrow F after removal of a sheet from the stack 19.

Figure 3:
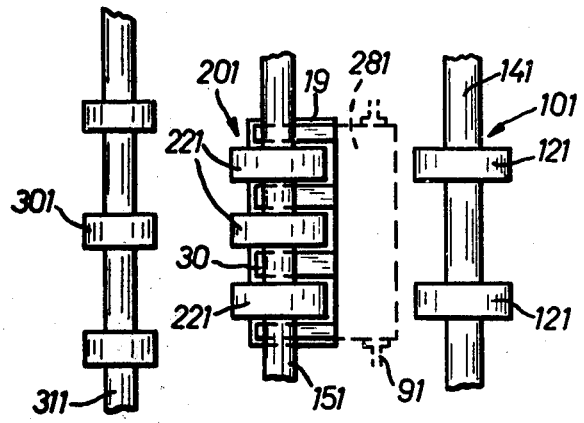
FIG. 3 illustrates a top view onto the sheet separating sets of rollers also showing the sheet separating gate in dashed lines below the table over which the sheets advance.

Above the table surface 10 and substantially at the same level as the first sheet separating roller set 5, there is arranged a second sheet separating roller set 7, which comprises several rollers 25 rigidly secured to a shaft 8 driven by a transmission member, such as a gear belt 26. The rollers 25 have the same diameter as the rollers 21. The diameter of the drive gears for the roller sets 5 and 7 are selected in such a manner that an upward translation is accomplished. In other words, the rollers 25 rotate faster than the rollers 21, or rather the circumferential speed of the rollers 25 is larger than that of the rollers 21. The rollers 25 of the second set 7 are located above a cut-out 27 in the table surface 10 as best seen in FIGS. 1 and 3. A separating gate 9 extends through the cut-out 27 at an angle relative to the table surface 10. Preferably, the angle is within the range of 8° to 15°.

Figure 5:
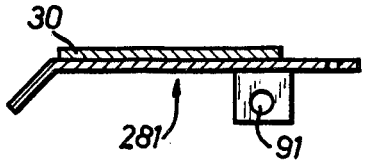
FIG. 5 is a sectional view through the sheet separating gate according to FIG. 4.

The separating gate 9 is supported in the housing also in see-saw fashion by a journal axis 91 (FIG. 5). A spring 28 urges the separating gate 9 in a counter-clockwise direction and thus with a slight pressure toward the rollers 25, however, without contacting these rollers directly. A bent over portion of the separating gate 9 extends substantially downwardly and rests against an adjustable stop member 29, whereby the spacing between the separating gate 9 and the rollers 25 may be varied within a limited range. The stop member 29 is adjustable from outside the housing of the apparatus and may comprise a cam member extending more or less toward the bent down portion of the separating gate 9 depending on the position of the stop member 29.

Figure 4:
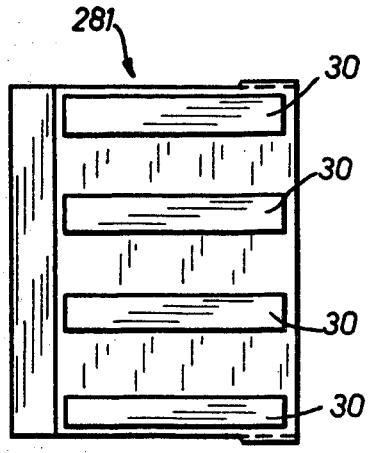
FIG. 4 is a top view onto the sheet separating gate.

As shown in FIGS. 4 and 5, the separating gate 9 is provided at its top surface with friction increasing means. Preferably, these friction increasing means are rubber strips 30 extending in the transport direction F. These rubber strips 30 increase the friction relative to a sheet of paper moving over the separating gate 9. The strips 30 are preferably made of soft rubber having a higher coefficient of friction relative to paper than steel. Thus, the individual sheets encounter a larger frictional resistance relative to the rubber strips 30 and thus against a movement in the transport direction F than on the table 10, whereby only the upper sheet will be transported and any sheet that might have left the stack below the top sheet will be retarded, so that only the top sheet will be transported in the direction of the arrow F. The rubber strips 30 extend upwardly somewhat above the level defined by the lower side of the rollers 25, whereby each individual sheet takes on a somewhat corrugated shape as it passes below the rollers 25 since the strips 30 are also spaced in such a manner that the rollers 25 are located above these spaces between the strips 30.

Figure 2:
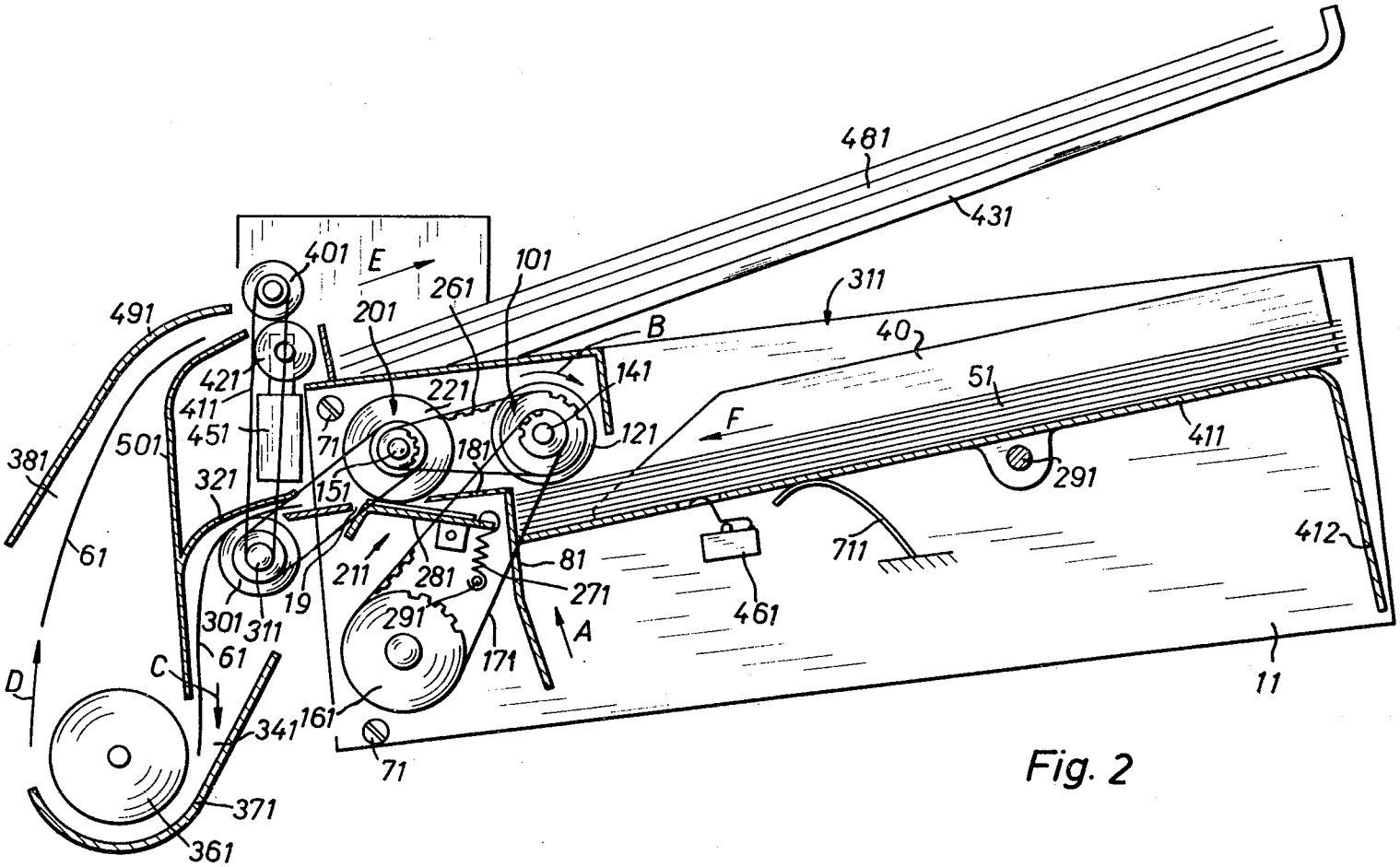
FIG. 2 is a sectional view similar to that of FIG. 1, however showing an improvement specifically illustrating the sheet guide means and the location of the sheet receiving tray substantially above the sheet supply tray.

Downstream of the second separating roller set 7 and horizontally spaced therefrom there are arranged two more roller sets 15 and 15 located vertically one above the other, or somewhat displaced relative to each other in the feed advance direction. The further roller sets 15 and 16 form a contact plane with the sheet to be transported or they form a narrow gap therebetween substantially in the plane of the top surface of the table 10. For this purpose, a further cut-out is provided in the table 10 as seen in FIG. 2, and the lower set of rollers 16 reaches through said further cut-out in the table 10. The drive for the roller set 15 is derived from the drive of the roller set 7 by means of a transmission member, such as a gear belt 32. An upward transmission or translation is provided between these two rollers to that the roller set 15 is driven faster than the roller set 7. Preferably, one of the two roller sets 15 or 16 is vertically adjustable or spring supported. In those instances, where the individual sheets are immediately taken up as they emerge from the gap between the gate 9 and the rollers 25, for example, by a further processing apparatus as shown in FIG. 2, it may not be necessary to employ the roller sets 15 and 16 at all.

The rollers 21, 25 and 33 are provided around their circumference with a soft rubber or a soft synthetic material layer having a relatively high friction coefficient relative to paper. Each of the rollers 21 and 25 and preferably also the rollers 33 and 34 are provided with a free wheeling take over mechanism. Such mechanisms are well known in the art, for example, in connection with free wheeling bicycle drives. These free wheeling rollers are capable of rotating faster than the speed determined by the drives through the gear belts 23, 26 and 32. This situation may occur when an individual sheet is taken up by the rollers 25 which have a larger circumferential speed than the rollers 21. The same situation would occur when the sheet is taken up between the rollers 33 and 34, since the set of rollers 15 is driven faster than the set of rollers 7. The increasing of the rotational speeds in the transport direction has the advantage that individual sheets are prevented from getting stuck.

The apparatus according to my above mentioned previous invention operates as follows. A stack 19 of paper sheets, which may have varying thicknesses up to the thickness of semi-cardboard, is manually placed on the support 2 so that the topmost sheet rests against the rollers 21 of the first set 5 of sheet separating rollers. The spring 4 presses the support 2 with a small force against these rollers 21 of the first set 5. The motor 24 is now started by pressing a button, not shown, whereby the first topmost sheet is transported in the direction F. Normally only the topmost sheet will be transported. However, if one or more additional sheets should be taken along, for example, when these sheets stick to each other, no problem will result, because of the arrangement of the cooperating parts relative to each other, whereby it is prevented that more than one sheet is supplied, for example, to a copier or to a typewriter platen 361 as shown in FIG. 2. The cooperation between the separating gate 9 and the second set of separating rollers 25 prevents a second sheet from travelling along with the top sheet in the direction of the arrow F. This is accomplished because only the top sheet is held against the rollers 25, whereas any sheet below the top sheet is retarded by the rubber strips 30 on the surface of the separating gate 9, because these rubber strips 30 have a relatively large friction coefficient relative to paper.

Due to the somewhat slanted position of the separating gate 9 relative to the table surface 10, a sheet advancing on the table is forced into a narrowing gap, whereby only the top sheet will be further transported. As soon as the top sheet is contacted by the second separating roller set 7, the speed of the sheet is increased in the direction of the arrow F, whereby the rollers 21 reach the same speed as the rollers 25 of the second set, because both rollers 21 and 25 roll along the same sheet. This is possible due to the free wheeling of these rollers similarly to the free wheeling or coasting of a bicycle. Thus, the rollers 21 may run faster than they are driven by the motor 24. As soon as a sheet has passed the rollers 21 of the set 5, the latter takes up the speed by which it is driven through the motor 24. This has the advantage that a spacing is established between successive sheets, which is important if, for example, the further handling of the sheets is controlled through photocells, which respond to such spacings between successive sheets.

As soon as a sheet, which is driven by the rollers 25 of the second set, comes into the gap between the rollers 33 and 34, these rollers further transport the sheet. The rollers 33 and 34 are driven faster than the rollers 25 of the second set 7. This further increases the spacing between two successive sheets. However, as mentioned, it might not be necessary to arrange the roller sets 15 and 16 as part of the present apparatus. Such rollers may form the input gap of a next successive machine or of an intermediate conveyor device.

The electrical control may be such that merely individual sheets are separated from the stack one at a time as needed, or the arrangement may be such that the sheet separation takes place in a continuous repeatedly successive operation. If the separation takes place only once in a while, the motor 24 may be started by pressing a respective button or the motor may receive a starting impulse from an apparatus arranged downstream of the present sheet separating device such as a typewriter or accounting machine. The motor is stopped by interrupting the energizing circuit for the motor 24 through a micro-switch 36, which responds to the trailing edge of a sheet passing over a sensing member 37 of a micro-switch 36, whereby the sensing member 37 reaches through the cut-out 27 in the table 10. Thus, the micro-switch 36 is actuated substantially as soon as the sheet leaves the gap between the rollers 25 and the gate 9. On the other hand, where a continuous operation is desired, it is the purpose of the micro-switch 36 to actuate a counter 41 which will switch off the motor 24 upon reaching a preadjusted number of sheets. These arrangements are as such well known in the art. Furthermore a micro-switch 35 having a sensing lever 38 reaching through an aperture in the support 2, whereby the switch 35 will stop the motor 24 when the last sheet of a stack 19 has been taken off the support 2. Incidentally, the entire apparatus may be constructed as a portable unit and provided with feet 39 to place it on a table or the like.

FIG. 2 illustrates the improvement according to the above mentioned copending Ser. No.: 779,755. The individual sheets 61 are removed from the stacks 51 and supplied to the platen 361, for example, of a typewriter or an accounting machine. From the platen 361 the sheets 61 with the typing thereon are moved in the direction of the arrow D and further in the direction of the arrow E onto a receiving stack 481 held on a receiving tray 431.

The sheet separating device 211 is substantially of the same structure as described above, with reference to FIG. 1, thus, the sheet separator proper 211 is arranged in a housing 311, the side walls of which support a sheet supply tray 411 in see-saw fashion, the supply tray 411 is again lurched in the direction of the arrow A by a spring 711. The downwardly bent end 412 of the tray 411 provides a limit stop for the clockwise movement of the tray 411. The sheets 61 are placed manually onto the tray 411 so that the leading edge of the sheets contact the stop 81 extending substantially at right angles to the feed advance direction F. The sheet separator 281 is also supported in see-saw fashion on an axle 291 in the side walls 11 of the housing 311. A first sheet separating set of rollers 101 is arranged above the stop 81 and above the supply stack 51. The first sheet separator set comprises a plurality of rollers 121 arranged in a row and supported on a horizontal shaft 141 to which the rollers 121 are rigidly secured against rotation. The shaft 141 is driven by a motor 161 through a gear belt 171, as indicated by the arrow B. Since the spring 711 of the sheet supply tray 411 with the stack 51 thereon presses the whole tray upwardly against the rollers 121, the leading end of the top sheet of the stack 51 contacts the rollers 121. The lowest generatrix of the rollers 121 is substantially at a level of a table 181 over which the sheets are individually transported. Preferably, the table 181 is an integral unit with the stop 81 and bent substantially at right angles, as shown in FIG. 2.

Above the table 181 as viewed in the transportion direction F, there are arranged downstream of the first set 101, a further set of sheet separating rollers 201 comprising a plurality of rollers 221 secured to a common shaft 151 driven by a gear belt 261 which derives its driving force from the motor 161 through the gear belt 171. The rollers 121 and the rollers 221 have the same diameter. Preferably, the gear belt 261 provides for an upward speed translation so that the rollers 201 run faster than the rollers 121. Thus, the circumferential speed of the rollers 221 is larger than that of the rollers 121.

The second set of rollers 201 is arranged above the cut-out 27, shown in FIG. 1, provided in the table 10 and also in the table 181 of FIG. 2. The separator gate 281 is arranged to reach through this cut-out and tiltable about its tilt axis 291. The tilting axis 291 is arranged below the table 181 and the spring 271 urges the sheet separator gate 281 against the rollers 221. os described, the gate 281 is also provided with a friction increasing means 30 as shown in FIG. 5. The friction increasing means 30 are preferably provided in strips as best seen in FIG. 4. The strips or a continuous coating may, for example, be made of soft rubber having a relatively high friction coefficient relative to paper so that the separated paper sheets encounter a higher friction relative to the separating gate 281 in the transport direction than on the table 181. The rubber strips extend above the level defined by the lowest generatrix of the rollers 221 so that a transported sheet will take on a slightly wavy, corrugated shape.

Further, as described, the rollers 121 and 221 are provided with a free wheeling over drive or idle running device so that they may run faster than the speed determined by the drive of the motor 161. This is the case, where the sheet is transported faster by the downstream sheet handling elements than by the speed determined by the motor 161. The just described sets of rollers 101 and 201 make sure that only one sheet at a time is supplied to the platen 361 over a guide roller 301 secured to a shaft 311 also driven by a gear belt through the previously mentioned gear belt 171 and 261. A guide member 321 is arranged to cooperate with the guide roller 301 for moving a sheet 51 into the entrance gap 341 defined between a further guide member 371 and the platen 361. This feed-in gap 341 may comprise conventional pressing rollers for the sheet 51 which rollers are now shown for simplicity's sake. The sheet 61 is now located behind the platen 361 in the feed-in gap 341 and as the platen 361 rotates, typing may begin, for example, a type head not shown. The platen is advanced line by line to move the sheet towards the front side of the platen 361 in the direction of the arrow D and thus into a funnel 381 which guides the sheets 61 between two guide members 491 and 501. The funnel 381 has such a shape that it diverts the sheet 61 into the direction E which is substantially opposite to the feed advance direction F.

At the output end of the funnels 381 there is arranged a pair of rollers 401 and 421 normally so spaced that the sheet emerging from the funnel may easily pass between these rollers 401 and 421 without any pull being applied to the sheet by the rollers. One of these rollers is supported on its axle in a manner permitting a shifting of the axle substantially up and down by means of electromagnets 451. If these electromagnets are energized, the respective roller is pressed against the other roller of the pair, whereby the sheet is firmly held between these rollers. One of the rollers is positively driven, for example, also through the motor 161 through gear belts 411, whereby the sheet is positively transported in the discharge direction E and onto the stack 481 held on a tray 431 in the form of rods or the like. Thus, it is possible, according to the invention, to arrange the two trays 411 and 431 substantially one above the other, as illustrated, which has the advantage that the space above the typewriter is not cluttered by the trays as in the prior art. The total angle between the two trays is within the range of 340° to 360°. The tilt of the supply tray 411 and also of the receiving tray 431 relative to the horizontal should not exceed 30°, preferably it should be within the range of 10° to 20°.

The control of the sheet supply may be arranged in response to the operation of the typewriter as is conventional. When all the sheets 51 are removed from the stack, the whole system, including the typewriter, may be stopped, for example, through a micro switch 461. Moreover, as mentioned above, the entire apparatus may be constructed as an attachment unit. The connection may either be of the slip-on or clip-on type or screws 71 may be used for the purpose.

Figures 6, 7A, 7B, 7C:
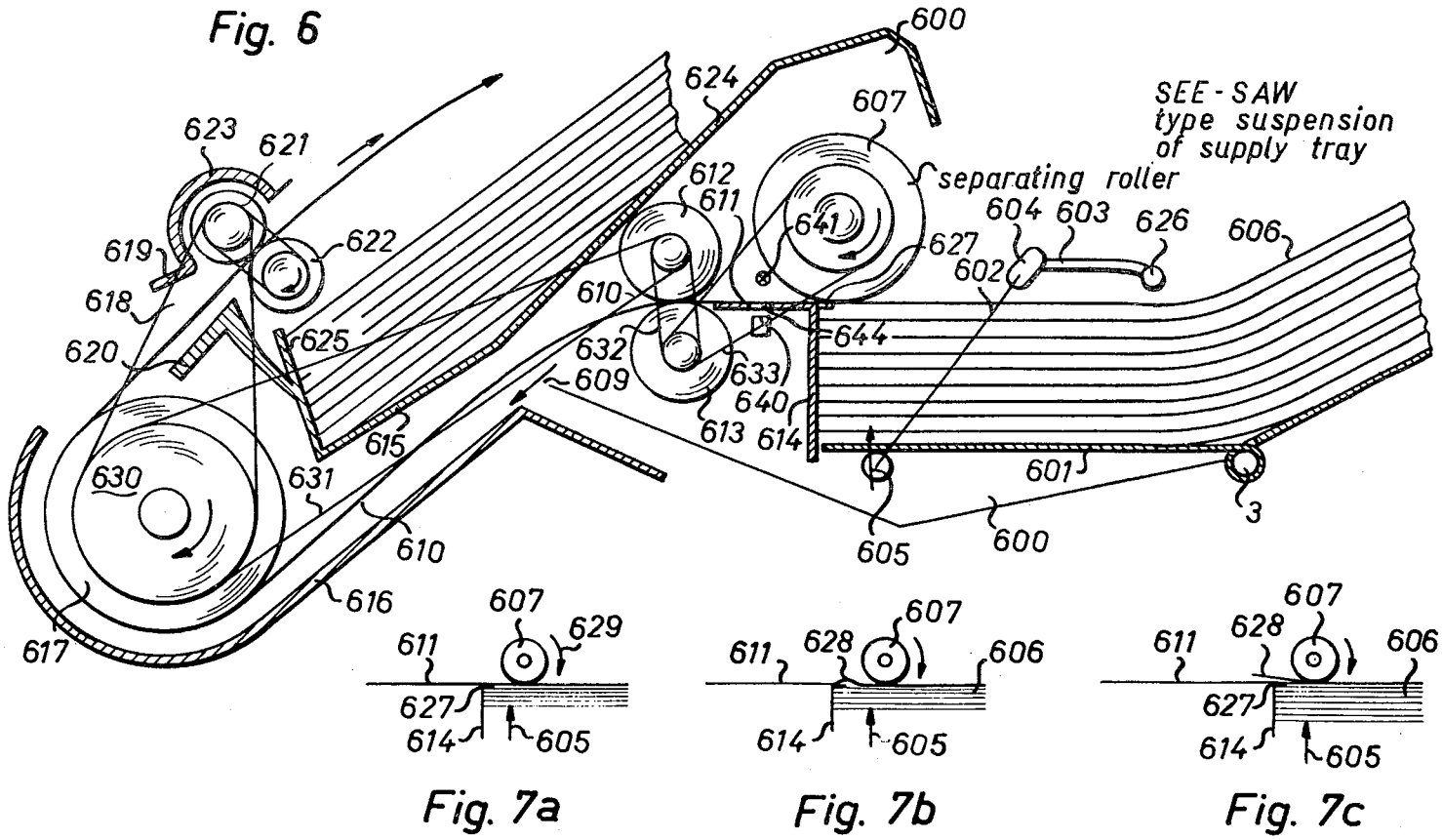
FIG. 6 is a sectional view of a further improvement of a sheet separating and feeding apparatus; according to the invention; and FIGS. *7a*, *7b*, & *7c* illustrate the feeding of single sheets or sets of sheets onto a guide table of FIG. 6.

FIG. 6 illustrates a further embodiment according to the invention which is patentably distinguished over the embodiments illustrated in my previous disclosures. The machine frame 600 supports a supply stack tray 601 in see-saw fashion by means of lever arms 602 pivoted to spring means 603 for movement guided in a longitudinal aperture 604. The spring means 603 are so arranged that they will urge the tray 601 upwardly in the direction of the arrow 605, whereby the top sheet 606 is urged against a separation roller 607 under the effect of the spring means 603. The spring means urging the tray 601 upwardly could also be so arranged as previously disclosed and shown in FIG. 2 with a spring 711.

The arrow 609 indicates the flow direction of the separated sheet 610. Downstream of the separation roller 607 there is arranged a stationary table 611 which guides a separated sheet into a gap between two positively driven transport rollers 612 and 613. The table 611 is preferably provided with a downwardly reaching extension 614 which forms a stop for the leading edges of the sheets on the tray 601. Preferably, the table 611 and the stops 614 form an integral unit.

Downstream of the first pair of transport rollers 612, 613, there are arranged first sheet guide means comprising an upper member 615 and a lower member 616. These guide means are preferably made of sheet metal or sufficiently rigid plastic material. The lower sheet guide member 616 guides a sheet 610 around the rotatable platen 617 and upwardly into a funnel shaped slot 618 formed by second guide means comprising an upper guide member 619 and a lower guide member 620. The funnel shaped guide slot 618 leads directly into a gap between a second pair of feed advance rollers 621 and 622. The guide members 619 may comprise a curved extension 623 forming a protective cover for the transport roller 621.

The separating roller 607, the first pair of transport rollers 612 and 613, as well as the second pair of transport rollers 621 and 622 are all positively driven, for example, by conventional gear belts 630–633 driven by the platen 617. Thus, separate motor drive means are not necessary for the just described rollers.

According to the invention the upper guide member 615 of the first guide means is so shaped as to form part of the receiving tray 624 which is supported in the machine frame 600 substantially above and somewhat to the left of the supply tray 601. The guide member 620 may be connected to an upwardly extending portion 625 of the tray forming guide member 615 or it may be connected to the machine frame. Similarly, the guide member 619 with its extension 623 is secured to the machine frame, for example, in a hinged manner as is known in the art. It is an advantage of the present invention that a minimum number of parts permit the transport of sheets from one tray 601 past the platen 617 onto a receiving tray 624 substantially above the platen and also somewhat above the supply tray. Essentially the present improvement uses only five rollers and two pairs of guide members as well as the guide tables 611 with its stop 614.

Incidentally, the spring means 603 may be pivoted about a point 626 and biassed in such a manner that movement of the upper end of the lever 602 in the clockwise direction causes the force 605 to urge the top sheet against the separation roller 607.

Referring to FIGS. *7a, 7b,* and *7c,* the table 611 with the stop member 614 form a corner 627 against which the leading edge 628 of the top sheet 606 is urged by the effect of the roller 607 as the latter rotates in the direction of the arrow 629. The resulting slide buckling action of the leading edge 628 as shown in FIG. *7b* causes the leading edge to jump over the corner 627 as shown in FIG. *7c.* This feature helps in separating one sheet at a time or one set of sheets.

According to the present improvement the pivoted guide 9 or the pivoted guide 281 previously disclosed have been obviated. Incidentally, the separation roller means 607 may comprise a plurality of axially aligned rollers.

After the sheet 606 has passed with its leading edge 628 the corner 627, the separating roller or rollers 607 feeds the sheet into the transport rollers 612, 613. All the rollers may be provided with friction increasing means as is conventional. The sheet guide means 615, 616 are deflecting the sheet 610 supplied by the sheet separating roller 607 at an angle of more than 10° but less than 60° in a downward direction.

The arrangement of the see-saw type suspension of the supply tray 601 also has the advantage of urging the sheets against the roller 607 with a substantially uniform force regardless whether many sheets or but a few sheets are on the tray 601. Another advantage of the invention is seen in that the electromagnet 451 of my previous invention is not necessary in the improvement because the rollers 621 and 622 are positively driven, for example, through gear belts by the platen 617 at the same or substantially the same circumferential speed. Another advantage is seen in that the receiving tray 624 may take up any desired angle rather than a substantially horizontal position.

The circumferential speed of the separating roller 607 is preferably slightly reduced compared with the transport rollers 612, 613. As soon as the top sheet is contacted by the transport rollers 612, 613, the speed of the sheet is increased in direction of arrow 609, whereby the separating roller 607 reaches the same peripheral speed as the transport rollers 612, 613. This is possible due to the free wheeling of these separating roller 607 similarily to the free wheeling or coasting of a bicycle. As soon as a sheet has passed the separating roller 607, the latter takes up the speed by which it is driven. This has the advantage that a spacing is established between successive sheets which is important if the further handling of the sheets is controlled through photocells, which respond to such spacings between successive sheets. Such a photocell 640 with a lamp 641 is arranged downstream the separating roller 607 and upstream the platen by example near a slot 644 in the table 611. The photocell could be replaced by a microswitch. Although the invention has been described with reference to specific example embodiments, it is to be understood, that it is intended to cover all modifications and equivalents within the scope of the appended claims.

What is claimed is:

1. A sheet feeding and receiving apparatus for directing sheets of paper to and receiving said sheets of paper from platen means in a typewriting machine, comprising driven free wheeling separating roller means, a pivotally mounted supply stack support, means resiliently urging the leading edge of a top sheet on said supply stack support against said driven free wheeling separating roller means, a stop engaging the lower sheets on said stack support, a set of positively driven first transport roller means positioned downstream of said separating roller means in the transport direction of sheets on said stack, separating means (627) for separating the uppermost sheet from said stack to inhibit the passage of more than one sheet at a time through the apparatus, said apparatus further comprising first sheet guide means for deflecting the sheet supplied by the sheet separating roller means at a deflection angle in a downward direction, receiving stack support means arranged partially above said pivotally mounted supply stack support, second sheet guide means arranged above and downstream of said platen means for directing sheets upwardly from below said platen means to said receiving stack support means for storing sheets received from said platen, and driven second transport roller means positioned above said platen means to feed sheets from said platen means to said receiving stack support means, said apparatus further comprising photocell means operatively arranged between said free wheeling separating roller means and said platen means for detecting a spacing between successive sheets, and drive means operatively interconnecting said free wheeling separating roller means, and said first and second transport roller means for driving said roller means from a common source.

2. The apparatus of claim 1, wherein said deflection angle is substantially within the range of about 10° to about 60°.

3. The apparatus of claim 1, wherein said transport roller means are driven with the same circumferential speed, and wherein the circumferential speed of said free wheeling separating roller means is smaller than the circumferential speed of said transport roller means whereby a spacing is formed between two successive sheets which is detected by said photocell means.

* * * * *